United States Patent [19]

Knox

[11] Patent Number: 5,031,777

[45] Date of Patent: Jul. 16, 1991

[54] MAGNETIC HOLDER FOR BOWS AND SIMILAR ACCESSORIES

[76] Inventor: Montye S. Knox, 7016 Whitemarsh Ct., Charlotte, N.C. 28210

[21] Appl. No.: 543,467

[22] Filed: Jun. 26, 1990

[51] Int. Cl.[5] ..... A47F 7/00

[52] U.S. Cl. ..... 211/13; 211/163; 211/DIG. 1; 248/309.4

[58] Field of Search ..... 248/309.4; 211/DIG. 1, 211/13, 163, 70

[56] References Cited

U.S. PATENT DOCUMENTS

| | | | |
|---|---|---|---|
| 2,893,564 | 7/1959 | Gearhart | 211/DIG. 1 X |
| 3,019,910 | 2/1962 | Greene | 248/309.4 X |
| 3,998,334 | 12/1976 | Smith | 211/70 X |
| 4,183,439 | 1/1980 | Bell | 211/DIG. 1 X |
| 4,463,856 | 8/1984 | Stressar | 211/163 |
| 4,850,658 | 7/1989 | Sandor | 211/163 X |
| 4,895,260 | 1/1990 | Ancona et al. | 211/163 X |

*Primary Examiner*—David L. Talbott

*Attorney, Agent, or Firm*—W. Thad Adams, III

[57] ABSTRACT

A magnetic display holder for hair bows and other accessories having ferromagnetic parts comprising a base defining an outer peripheral edge and a top defining an outer peripheral edge. At least one support member connects the top and base together and supports the top in vertically spaced-apart relation to the base. A thin sheet or a plurality of thin bow-holding strips are connected to the respective peripheral edges of the top and base and extend substantially vertically between the base and the top of the display holder. Each of the strips define an outwardly facing side and an obverse inwardly-facing side. A plurality of magnets are positioned in vertically spaced-apart relation along the inwardly facing side of the bow-holding strips.The magnets exert sufficient magnetic attraction through the bow-holding strips to hold bows or other accessories having ferromagnetic parts solely by magnetic attraction to the outwardly facing side of the strip opposite the magnets.

13 Claims, 2 Drawing Sheets

14
16
16
15
16
16
10
15
13
16
16
15
15
16
16
12
11
11

MAGNETIC HOLDER FOR BOWS AND SIMILAR ACCESSORIES

TECHNICAL FIELD AND BACKGROUND OF THE INVENTION

This invention relates to a magnetic display holder for holding hair bows and similar accessories such as buckles, earrings and other personal accessories and jewelry which have ferromagnetic parts. For purposes of describing the invention in this application reference will be made to hair bows, it being understood that the display holder is useful for displaying other small objects as well.

The holder is intended to organize and display a relatively large number of bows. The display of the bows permits easy selection and removal of one or more bows from the holder when desired without disturbing the remaining ones. In addition, the holder is intended to be attractive, decorative and entertaining, particularly to small children. Small children will find it particularly easy to use, since all that is required is to place the bow in proximity to the magnet to secure it to the holder, and to pull the bow away from the holder to remove it.

It is well known that the magnetic attraction is inversely proportional to the square of the distance of the magnet from the attracted object. In other words, if the distance between the magnet and the attracted object is doubled, the magnetic attraction between them is only one fourth as great. For this reason, it is important to keep the distance between the magnet and the attracted item as small as possible. This is accomplished in the invention described in this application by using the holding strips only to hold the magnets, which providing other means for mounting the top and base apart from each other.

SUMMARY OF THE INVENTION

Therefore, it is an object of the invention to provide a magnetic display holder for bows and other accessories having ferromagnetic parts.

It is another object of the invention to provide a magnetic display holder having a decorative appearance.

It is another object of the invention to provide a magnetic display holder which permits magnets to be attached in such a way as not to be seen from and yet to satisfactorily hold the bows.

These and other objects of the present invention are achieved in the preferred embodiments disclosed below by providing a magnetic display holder for hair bows and other accessories having ferromagnetic parts comprising a base defining an outer peripheral edge and a top defining an outer peripheral edge. At least one support member connects the top and base together and supports the top in vertically spaced-apart relation to the base. A thin sheet or a plurality of thin bow-holding strips are connected to the respective peripheral edges of the top and base and extend substantially vertically between the base and the top of the display holder. Each of the strips define an outwardly facing side and an obverse inwardly-facing side. A plurality of magnets are positioned in vertically spaced-apart relation along the inwardly facing side of the bow-holding strips. The magnets exert sufficient magnetic attraction through the bow-holding strips to hold bows or other accessories having ferromagnetic parts solely by magnetic attraction to the outwardly facing side of the strip opposite the magnets.

According to one preferred embodiment of the invention, the base and the top are each circular and the support member extends between the center of the base and the center of the top.

According to another preferred embodiment of the invention, the bow-holding strips comprise fabric.

According to yet another preferred embodiment of the invention, the bow-holding strips comprise flexible plastic sheet material.

Preferably, the base is mounted on a pedestal for supporting the base above a supporting surface.

According to one preferred embodiment of the invention, the pedestal includes means for rotating the base relative to the pedestal.

According to another preferred embodiment of the invention, the pedestal is mounted in fixed relation on the base.

According to yet another preferred embodiment of the invention, the magnets are attached to the bow holding strips with an adhesive.

According to yet another preferred embodiment of the invention, a magnetic display holder for hair bows and other accessories having ferromagnetic parts is provided and comprises a base defining a circular outer peripheral edge and a top defining a circular outer peripheral edge. A centrally mounted rigid support member is attached to the center of the base and the center of the top and connects the top and base together. The support member supports the top in vertically spaced-apart relation to the base.

A plurality of fabric bow-holding strips are connected to the respective circular peripheral edges of the top and base and extend substantially vertically between the base and the top of the display holder. Each of the strips define an outwardly facing decorative side and an obverse inwardly-facing side. A plurality of magnets are positioned in vertically spaced-apart relation along the inwardly facing side of the bow-holding strips and exert sufficient magnetic attraction through the bow-holding strips to hold bows or other accessories having ferromagnetic parts solely by magnetic attraction to the outwardly facing side of the strip opposite the magnets.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
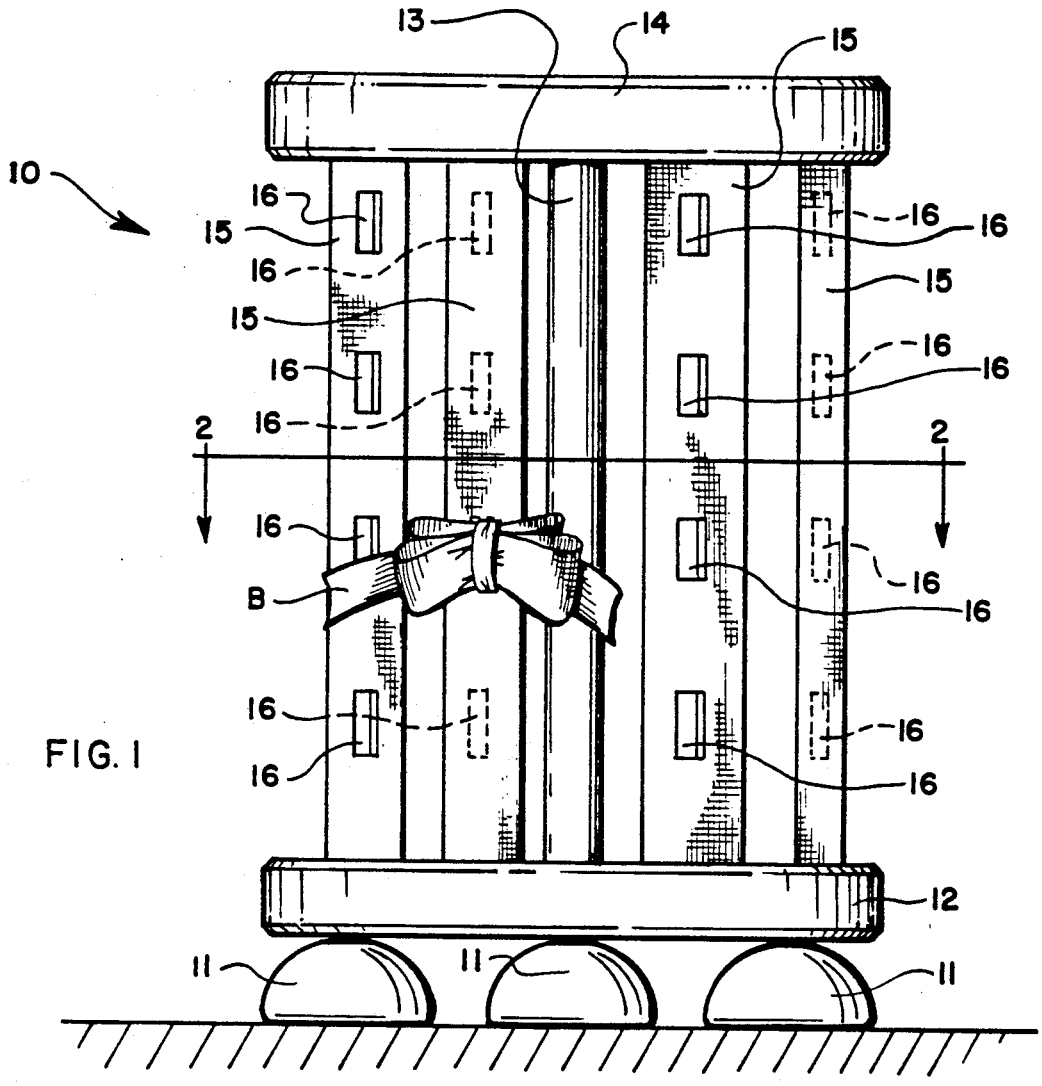
FIG. 1 is a side elevation of the holder shown in FIG. 1.

Referring now specifically to the drawings, a magnetic display holder for bows according to the present invention is illustrated in FIG. 1 and shown generally at reference numeral 10.

Holder 10 includes a pedestal 11, which as shown in FIG. 1 may be three short legs 11, on which is mounted a base 12. Pedestal 11 may be fixed to base 12 in such a way as merely to support base 12 of the supporting surface as is shown in FIG. 1. Alternatively, base 12 may be mounted on a pedestal so that the base 12 can be rotated. A further variation is to mount the base 12 on a pedestal which comprises a music box which turns as it plays, or another type of pedestal which can supply powered rotation to the base 12.

According to the preferred embodiment illustrated in the drawings, the base 12 and top 14 are each 8.5 inches (21.6 cm) in diameter.

A support member 13, such as a wooden or plastic dowel, is secured to the center of base 12 and supports a top 14 which is secured to the other end of support member 13. According to the preferred embodiment illustrated in the drawings, the support member 13 supports the base 12 and top 14 nine (9) inches 23 cm) apart.

Figure 2:
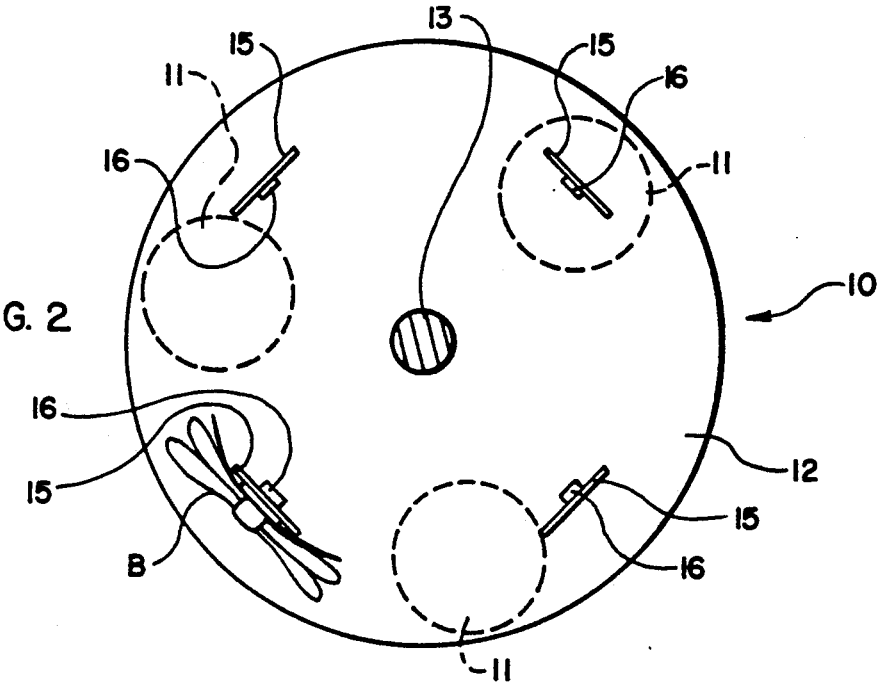
FIG. 2 is a cross-section taken along lines 2—2 of FIG. 2.
Figure 3:
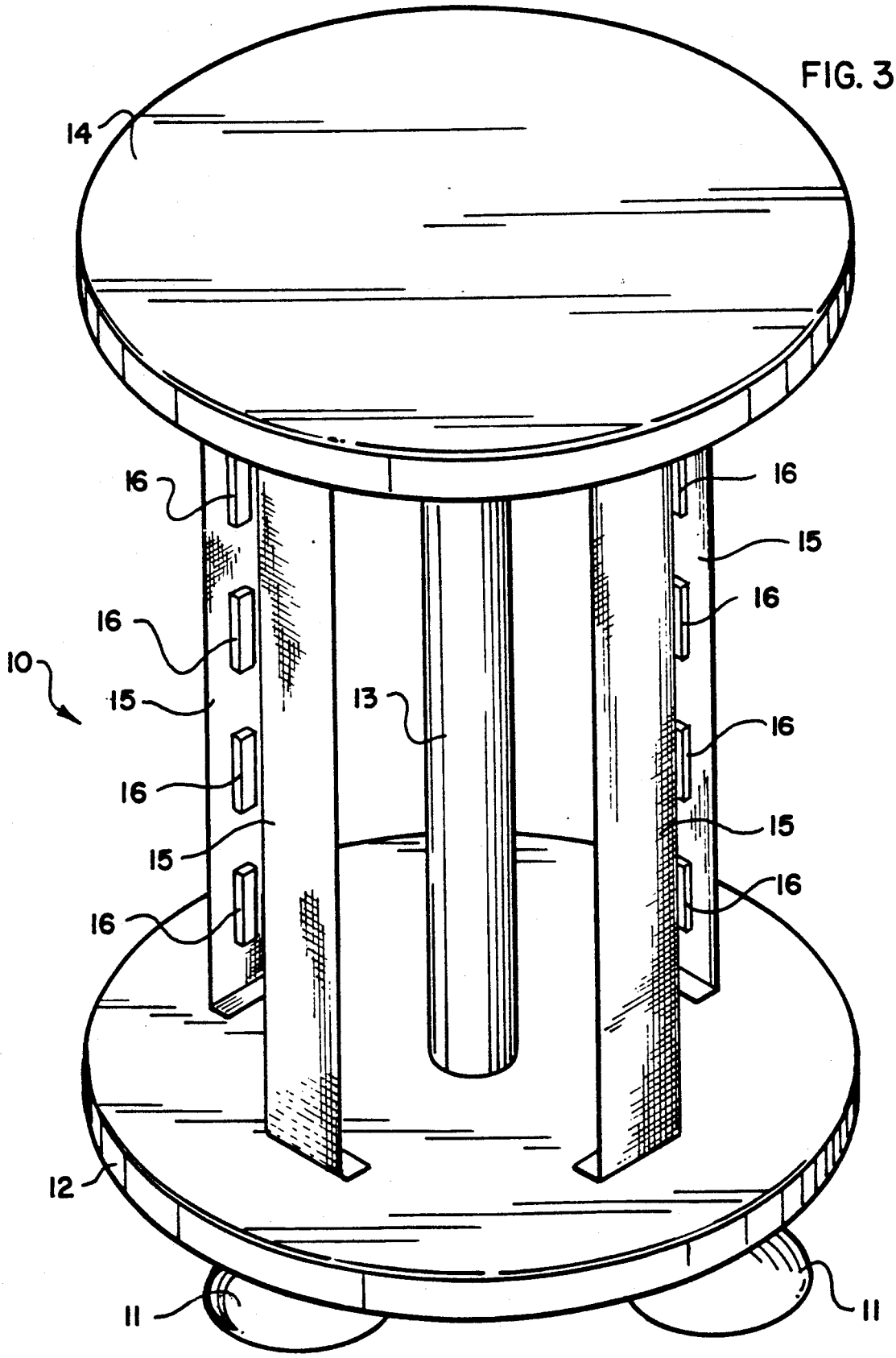
FIG. 3 is a perspective view of a holder according to the embodiment of the invention described in the application.

Referring now to FIGS. 1 and 2, 4 relatively narrow, thin fabric strips 15 are secured by opposite ends to the base 12 and top 14, respectively. The strips 15 are fastened by staples, glue or other suitable means, and are taut, but not stretched. As is apparent, the strips do not support any of the structure of the holder 10, so they can be of any suitable thin material such as any suitable fabric, other materials such as plastic sheeting or even very thin wooden lathing strips. Preferably, the strips 15 have decoration on the outwardly facing sides.

Alternatively, a thin fabric or plastic sheet could be extended around so as to completely surround the base 12 and top 14. In either case, the strips 15 may be secured to the base 12 and top 14 inwardly from the periphery as shown in the Figures, are attached to the side edges of the base 12 and top 14.

Small magnets 16 are adhered by adhesive or by other suitable means to the inwardly facing side of the strips 15. The magnets 16 are vertically spaced-apart along the length of the strips 15 so that several magnets 16, perhaps between four and eight depending of the length of the support member 13, are adhered to each strip 15. The magnetic attraction of the magnets 16 through the fabric strips 15 creates sufficient attraction so that a hair bow "B" having a ferromagnetic clip or mounting is easily held onto the front of the strip 15 by the attraction of the magnet 16 alone.

Alternatively, the strips 15 could be formed of thin sheets of plastic or rubber having a magnetic coating or being impregnated with magnetic material. This type of product is readily available in a number of sizes.

Decoration of the holder is virtually unlimited. The design of the holder 10 shown in the drawings resembles a merry-go-round, but the base and top can be any desired shape.

A bow holder is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A magnetic display holder for hair bows and other accessories having ferromagnetic parts, comprising:

(a) a base defining an outer peripheral edge;

(b) a top defining an outer peripheral edge;

(c) at least one support member for connecting the top and base together, and supporting the top in vertically spaced-apart relation to the base.

(d) a thin bow-holding sheet connected to the respective peripheral edges of the top and base and extending substantially vertically between the base and the top of the display holder, said sheet defining an outwardly facing side and an obverse inwardly-facing side; and (e) magnetic means cooperating with said thin sheet for exerting sufficient magnetic attraction through the bow-holding sheet to hold bows or other accessories having ferromagnetic parts on the sheet solely by magnetic attraction, said magnetic means comprising a plurality of individual magnets positioned in vertically widely spaced-apart relation to the inwardly-facing side of the strips, each magnet being sufficiently widely spaced-apart from adjacent magnets to hold a single bow or other accessory.

2. A magnetic display holder for bows according to claim 1, wherein said base and said top are each circular, said support member extends between the center of the base and center of the top and said sheet comprises a plurality of spaced-apart narrow strips.

3. A magnetic display holder for bows according to claim 2, wherein said bow-holding strips comprise fabric.

4. A magnetic display holder for bows according to claim 2, wherein said bow-holding strips comprise flexible plastic sheet material.

5. A magnetic display holder for bows according to claim 2, wherein said magnets are attached to said bow-holding strips with an adhesive.

6. A magnetic display holder for bows according to claim 1, wherein said base is mounted on a pedestal for supporting the base above a supporting surface.

7. A magnetic display holder for bows according to claim 6, wherein said pedestal includes means for rotating the base relative to said pedestal.

8. A magnetic display holder for bows according to claim 6, wherein said pedestal is mounted in fixed relation on said base.

9. A magnetic display holder for hair bows and other accessories having ferromagnetic parts, comprising:

(a) a base defining a circular outer peripheral edge;

(b) a top defining a circular outer peripheral edge;

(c) a centrally mounted rigid support member attached to the center of the base and the center of the top for connecting the top and base together, and supporting the top in vertically spaced-apart relation to the base;

(d) a plurality of fabric bow-holding strips connected to the respective circular peripheral edges of the top and base and extending substantially vertically between the base and the top of the display holder, each of said strips defining an outwardly facing decorative side and an obverse inwardly-facing side; and (e) a plurality of individual magnets positioned in widely vertically spaced-apart relation along the inwardly facing side of the bow-holding strips for exerting sufficient magnetic attraction through the bow-holding strips to hold bows or other accessories having ferromagnetic parts solely by magnetic attraction to the outwardly facing side of the strip opposite the magnets, each magnet being sufficiently widely spaced-apart from adjacent magnets to hold a single bow or other accessory.

10. A magnetic display holder for bows according to claim 9, wherein said base is mounted on a pedestal for supporting the base above a supporting surface.

11. A magnetic display holder for bows according to claim 10, wherein said pedestal includes means for rotating the base relative to said pedestal.

12. A magnetic display holder for bows according to claim 10, wherein said pedestal is mounted in fixed relation on said base.

13. A magnetic display holder for bows according to claim 9, wherein said magnets are attached to said bow holding strips with an adhesive.

* * * * *